US010647107B2

(12) United States Patent
Yu et al.

(10) Patent No.: US 10,647,107 B2
(45) Date of Patent: May 12, 2020

(54) ULTRAVIOLET CURING APPARATUS

(71) Applicant: SAMSUNG ELECTRONICS CO., LTD., Suwon-si, Gyeonggi-do (KR)

(72) Inventors: Ho Yu, Pohang-si (KR); Dong Wook Kim, Seoul (KR); Byeong Sang Kim, Hwaseong-si (KR); Kyung Bin Park, Seoul (KR); Ki Ju Sohn, Gunpo-si (KR); Ju Hyun Lee, Suwon-si (KR)

(73) Assignee: Samsung Electronics Co., Ltd., Suwon-Si, Gyeonggi-do (KR)

( * ) Notice: Subject to any disclaimer, the term of this patent is extended or adjusted under 35 U.S.C. 154(b) by 97 days.

(21) Appl. No.: 15/982,146

(22) Filed: May 17, 2018

(65) Prior Publication Data

US 2019/0134974 A1 May 9, 2019

(30) Foreign Application Priority Data

Nov. 8, 2017 (KR) ..... 10-2017-0147875

(51) Int. Cl.

| | |
|---|---|
| ***B41F 23/04*** | (2006.01) |
| ***B41M 7/00*** | (2006.01) |
| ***F26B 3/28*** | (2006.01) |
| ***B05D 3/06*** | (2006.01) |

(52) U.S. Cl.

CPC ..... *B41F 23/0409* (2013.01); *B05D 3/067* (2013.01); *B41F 23/0453* (2013.01); *B41M 7/0045* (2013.01); *B41M 7/0081* (2013.01); *F26B 3/283* (2013.01)

(58) Field of Classification Search

CPC .... B41F 23/0409; B41F 23/0453; F26B 3/28; F26B 3/283; B41M 7/0081; A45D 2200/205; B05D 3/061

See application file for complete search history.

(56) References Cited

U.S. PATENT DOCUMENTS

| | | | | |
|---|---|---|---|---|
| 3,733,709 | A * | 5/1973 | Bassemir | B41F 23/04 34/277 |
| 3,826,014 | A * | 7/1974 | Helding | F26B 3/28 34/277 |
| 3,914,594 | A * | 10/1975 | Helding | F26B 3/28 362/218 |
| 3,930,318 | A * | 1/1976 | Stelter | B41F 23/0409 34/277 |
| 8,038,431 | B2 | 10/2011 | Sano et al. | |
| 8,480,946 | B2 | 7/2013 | Mikami et al. | |
| 2005/0181293 | A1 | 8/2005 | Lee | |
| 2010/0148407 | A1 | 6/2010 | Park et al. | |
| 2014/0346713 | A1 | 11/2014 | Wada | |

(Continued)

FOREIGN PATENT DOCUMENTS

| | | |
|---|---|---|
| JP | 2011-143679 A | 7/2011 |
| JP | 2014-195088 A | 10/2014 |

(Continued)

*Primary Examiner* — David J Laux

(74) *Attorney, Agent, or Firm* — Lee IP Law, PC

(57) ABSTRACT

An ultraviolet curing apparatus includes a housing, a plurality of ultraviolet light emitting diodes (LEDs) arranged in a length direction of the housing, and at least one shutter part coupled to the housing to be movable in the length direction, to cover at least a portion of the plurality of ultraviolet LEDs to limit an irradiation region of ultraviolet light emitted by the plurality of ultraviolet LEDs.

18 Claims, 4 Drawing Sheets

(56) References Cited

U.S. PATENT DOCUMENTS

| | | | |
|---|---|---|---|
| 2015/0197059 | A1 | 7/2015 | Usui |
| 2015/0314323 | A1 | 11/2015 | Park et al. |

FOREIGN PATENT DOCUMENTS

| | | | |
|---|---|---|---|
| JP | 2016-018824 | A | 2/2016 |
| JP | 2016-058735 | A | 4/2016 |
| KR | 10-2011-0135777 | A | 12/2011 |

* cited by examiner

ULTRAVIOLET CURING APPARATUS

CROSS-REFERENCE TO RELATED APPLICATION

Korean Patent Application No. 10-2017-0147875, filed on Nov. 8, 2017, in the Korean Intellectual Property Office, and entitled: "Ultraviolet Curing Apparatus," is incorporated by reference herein in its entirety.

BACKGROUND

1. Field

The embodiments relate to an ultraviolet (UV) curing apparatus.

2. Description of the Related Art

Nanoimprint lithography is used to form fine large-area patterns needed for display devices of increased size. In nanoimprint lithography, after a photocurable resin is coated on a substrate, ultraviolet light is irradiated there onto, while a stamp having a concavo-convex pattern corresponding to a fine pattern is pressed on the photocurable resin, to cure the photocurable resin, and then the stamp is separated therefrom, thereby forming fine patterns.

SUMMARY

According to an aspect, an ultraviolet curing apparatus includes a housing, a plurality of ultraviolet light emitting diodes (LEDs) arranged in a length direction of the housing, and at least one shutter part coupled to the housing to be movable in the length direction, to cover at least a portion of the plurality of ultraviolet LEDs to limit an irradiation region of ultraviolet light emitted by the plurality of ultraviolet LEDs.

According to an aspect, an ultraviolet curing apparatus includes a housing having one surface formed in a length direction, a plurality of ultraviolet LEDs arranged on the one surface in the length direction, a controller selectively controlling an on/off operation of the plurality of ultraviolet LEDs to adjust an irradiation region of ultraviolet light emitted by the plurality of ultraviolet LEDs, a driving unit controlled by the controller, and at least one shutter part covering at least a portion of the one surface, to provide a region in which the ultraviolet light is blocked, and movably coupled in the length direction by the driving unit.

According to an aspect, an ultraviolet curing apparatus includes a linear housing positioned above an imprint mold, a plurality of ultraviolet LEDs arranged in the housing in a length direction of the housing, to irradiate ultraviolet light onto the imprint mold, at least one shutter part movably coupled to the housing in the length direction, to block a space between the plurality of ultraviolet LEDs and the imprint mold, a driving unit disposed on the housing to move the at least one shutter part in the length direction, and a controller selectively controlling an on/off operation of the plurality of ultraviolet LEDs to adjust an irradiation region of ultraviolet light emitted by the plurality of ultraviolet LEDs, and controlling a region in which the at least one shutter part blocks the irradiation region by controlling the driving unit.

BRIEF DESCRIPTION OF THE DRAWINGS

Features will become apparent to those of ordinary skill in the art by describing in detail exemplary embodiments with reference to the attached drawings in which.

DETAILED DESCRIPTION

Hereinafter, example embodiments will be described with reference to the accompanying drawings.

Figure 1:
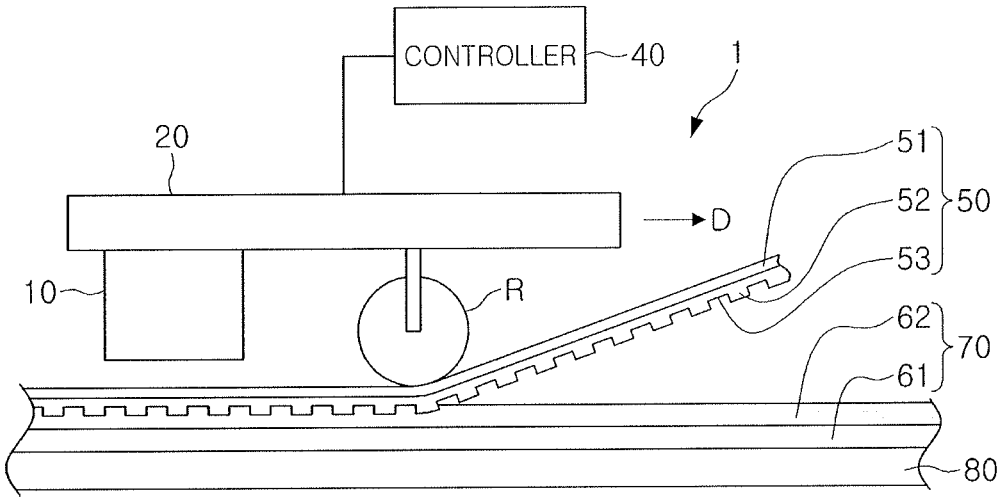
FIG. 1 illustrates a schematic cross-sectional view of an imprinting device to which an ultraviolet curing apparatus according to an example embodiment.
Figure 2:
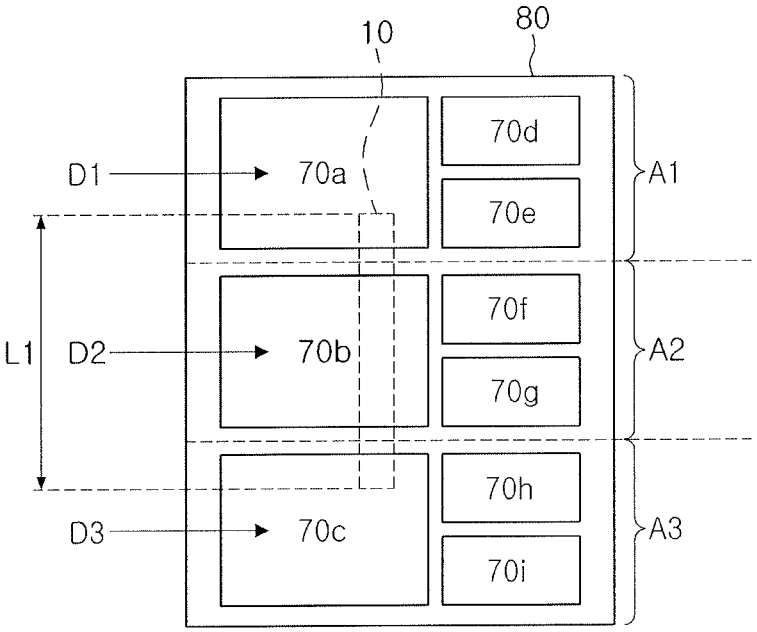
FIG. 2 illustrates a plan view of a process of irradiating ultraviolet light from above an imprint mold by the ultraviolet curing apparatus of FIG. 1.

FIG. 1 is a schematic cross-sectional view of an imprinting device to which an ultraviolet curing apparatus according to an example embodiment is applied, and FIG. 2 is a plan view of a process of irradiating ultraviolet light from above an imprint mold by the ultraviolet curing apparatus of FIG. 1.

With reference to FIGS. 1 and 2, an ultraviolet curing apparatus 10 according to an example embodiment may be employed in an imprinting device 1 to be used in a process of curing a display cell 70 disposed on a stage 80. In detail, the imprinting device 1 may include a frame 20 moving above the stage 80, the ultraviolet curing apparatus 10 on a lower portion of the frame 20, e.g., between the frame and the stage 80, and a pressing roller R rotatably coupled to the lower portion of the frame 20. The frame 20, the ultraviolet curing apparatus 10, and the pressing roller R may be controlled by a controller 40. The ultraviolet curing may include a hardening process.

The imprinting device 1 may press an imprint mold 50 from one side to another side to attach the imprint mold to an imprint material 62 coated on an upper surface of a glass substrate 61. In addition, as the imprinting device 1 cures the imprint material using the ultraviolet curing apparatus 10, a concavo-convex pattern 53 of the imprint mold 50 may be transferred to the imprint material 62. In an example embodiment, the imprint mold 50 may be a flexible substrate formed by attaching a stamp 52 having the concavo-convex pattern 53 to an elastic tape 51, and the imprint material 62 may be ink in which a photocurable resin is diluted in a diluted solution.

As illustrated in FIG. 2, display cells 70*a* to 70*i* having various sizes may be on the stage 80. As shown in FIG. 2, reference numerals 70*a* to 70*c* and 70*d* to 70*i* refer to sets of display cells having the same size, respectively, as an example. The ultraviolet curing apparatus 10, according to an example embodiment, may move above the stage 80 in a single direction D to cure the display cells 70*a* to 70*i*. In this case, a curing process may only be performed within widths A1, A2 and A3, along a length L1. In an example embodiment, the ultraviolet curing apparatus 10 may move in a direction D1, to cure display cells 70*a*, 70*d* and 70*e*; may move in a direction D2 to cure display cells 70*b*, 70*f* and 70*g*; and then may move in a direction D3 to cure display cells 70*c*, 70*h* and 70*i*. Increasing the length L1 of the ultraviolet curing apparatus 10 in order to correspond to display cells having various sizes is financially impractical.

Therefore, a plurality of display cells 70*a* to 70*i* may be cured a plurality of times. For example, a display cell, adjacent to a display cell to be cured, may be inadvertently cured. In detail, referring to FIG. 2, in a process of curing the display cell 70*b*, ultraviolet light may be irradiated onto a portion of a display cell 70*c*, adjacent to the display cell 70*b*, such that only a portion of the adjacent display cell 70*c* may be cured. When the display cell 70*c* is then cured, imprint material in that portion of the display cell first exposed to ultraviolet light, may be subjected to excessive curing. Thus, a transferred concavo-convex pattern may be distorted.

Thus, as noted above, when a variety of sizes of display devices are to be manufactured in a single production line, irradiated ultraviolet light may be difficult to precisely control. Thus, unexpected hardening of a photocurable resin may occur in a display device adjacent to the display device being cured.

In contrast, the ultraviolet (UV) curing apparatus 10 according to an example embodiment may provide UV light limited to a size corresponding to a display cell to be cured. Thus, UV light may be prevented from being irradiated onto an adjacent display cell.

Figure 3:
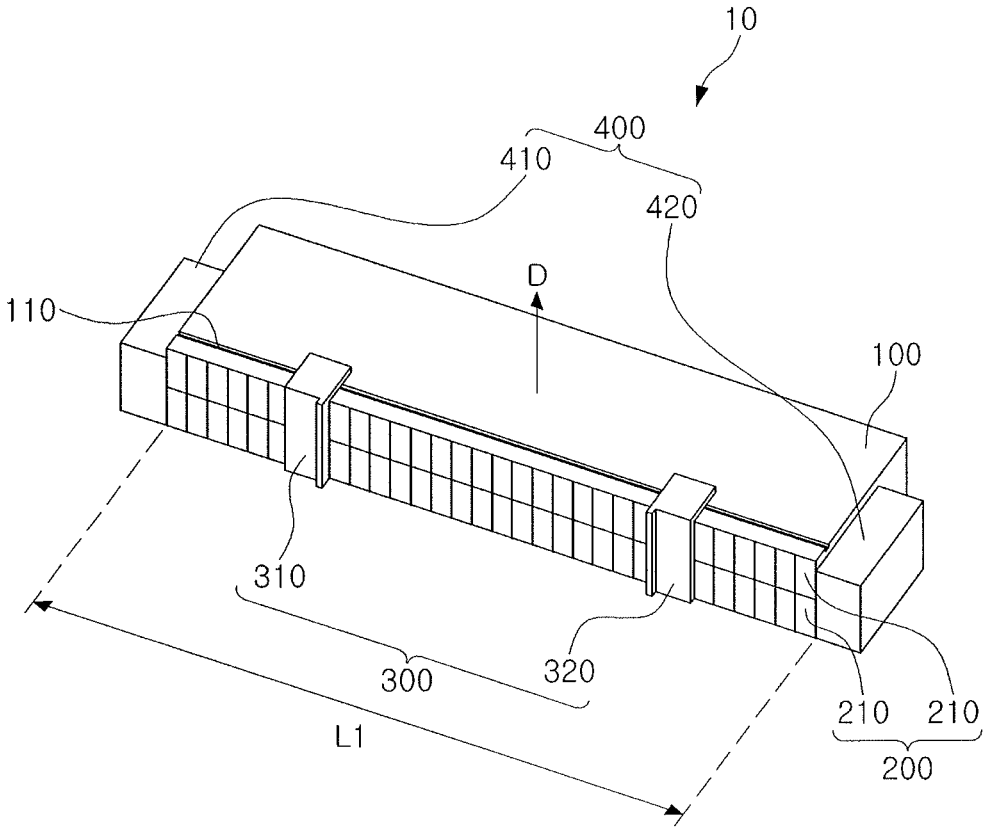
FIG. 3 illustrates a perspective view of an ultraviolet curing apparatus according to an example embodiment.

Referring to FIGS. 1 and 3, the UV curing apparatus 10 according to an example embodiment may include a housing 100, a plurality of ultraviolet light emitting diodes (LED) 200, a shutter part 300, a driving unit 400 driving the shutter part 300, and the controller 40 controlling the plurality of UV LEDs 200 and the driving unit 400.

The housing 100 may be provided as a linear casing having a rectangular shape with a space portion therein, and may have a shape elongated in a length (L1) direction. The plurality of UV LEDs 200 to be described below may be in the space portion of the housing 100. A coupling groove portion 110, to which the shutter part 300, to be described later, is movably coupled, may be formed on at least one side of the housing 100.

The plurality of UV LEDs 200 may be mounted to be arranged in parallel on a circuit board, e.g., a printed circuit board (PCB), and then, may be disposed inside the housing 100. The circuit board may serve as a support supporting the plurality of UV LEDs 200, and may be electrically connected via a circuit wiring. The circuit board 120 may be selectively provided, and may also be omitted, depending on an example embodiment. In the case of an example embodiment, a plurality of UV LEDs 210 are illustrated as being arranged in two lines in the length (L1) direction, but are not limited thereto, e.g., UV LEDs may be arranged in a two-dimensional matrix. On/off operations of respective UV LEDs 210 in the plurality of UV LEDs 200 may be individually controlled by the controller 40 to be described later.

The plurality of UV LEDs 200 may be semiconductor light emitting diodes formed by epitaxially growing a semiconductor layer on a growth substrate, and may generate ultraviolet light when power is applied thereto. Each UV LED 210 may have a structure in which an n-type semiconductor layer, a p-type semiconductor layer, and an active layer therebetween, are stacked. In addition, the n-type semiconductor layer and the p-type semiconductor layer may be configured by a nitride semiconductor including $Al_xIn_yGa_{1-x-y}N(0 \le x \le 1,\ 0 \le y \le 1,\ 0 \le x+y \le 1)$.

Although the plurality of UV LEDs 200 may emit a single wavelength, the plurality of UV LEDs 200 may also emit a plurality of wavelengths. In this case, only UV LEDs 200 having a suitable wavelength, depending on an applied photocurable resin type, may be selected to be turned on or off Thus, in the case of the UV curing apparatus 10, conversion per wavelength may be performed depending on a photocurable resin type.

For example, a UV LED 200 having a wavelength of 365 nm and a UV LED 200 having a wavelength of 280 nm may be alternately arranged, a UV LED 200 having a wavelength of 375 nm and a UV LED 200 having a wavelength of 385 nm may be alternately arranged, or a plurality of UV LEDs 200 having different wavelengths within a wavelength range of 265 nm to 460 nm may be alternately arranged. As such, the UV curing apparatus 10, in which conversion per wavelength may be performed, depending on a photocurable resin type, may also be implemented.

The shutter part 300 may be coupled to front portions of the plurality of UV LEDs 200, to be moved in the length (L1) direction, in such a manner that at least a portion of UV light irradiated by the plurality of UV LEDs 200 may be blocked to provide a blocked region. In an example embodiment, the shutter part 300 may be coupled to a side of the housing 100, to be movable in the coupling groove portion 110 formed in the length (L1) direction, but is not limited thereto.

The shutter part 300 may include a first shutter portion 310 and a second shutter portion 320. The first and second shutter portions 310 and 320 may be symmetrically disposed on both ends of an irradiation region B1 of ultraviolet light emitted by the plurality of UV LEDs 200, respectively. For example, the first and second shutter portions 310 and 320 may be spaced apart from respective ends of the housing 100 along the length (L1) direction by a same distance, as shown in FIG. 2. In the particular embodiment of FIG. 2, the first shutter portion 310 and a second shutter portion 320 may extend from the front surface onto a side surface of the housing 100 and have a protrusion extending therefrom into the coupling groove portion 110 such that they are movable therein. The first and second shutter portions 310 and 320 may have the same configuration. As such, mainly the first shutter portion 310 will be described below.

Figure 4:
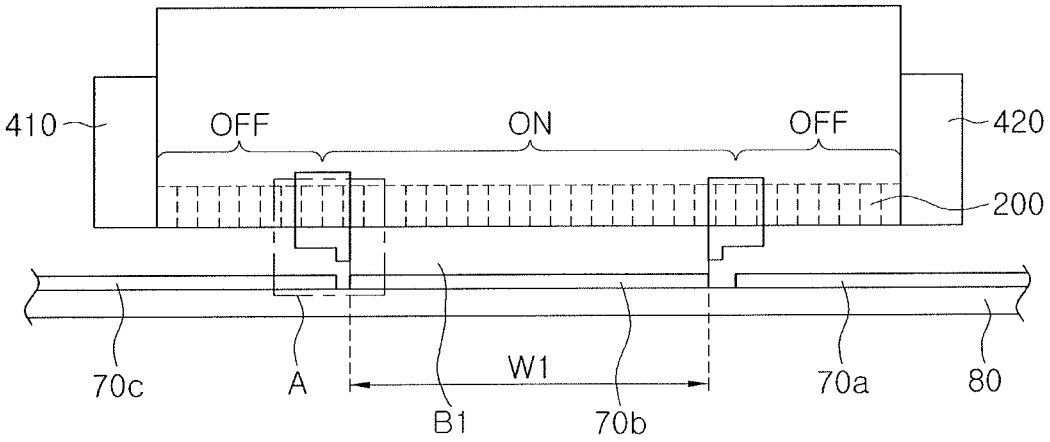
FIG. 4 illustrates a cross-sectional view illustrating that the ultraviolet curing apparatus of FIG. 3 irradiates ultraviolet light onto an imprint mold.
Figure 5:
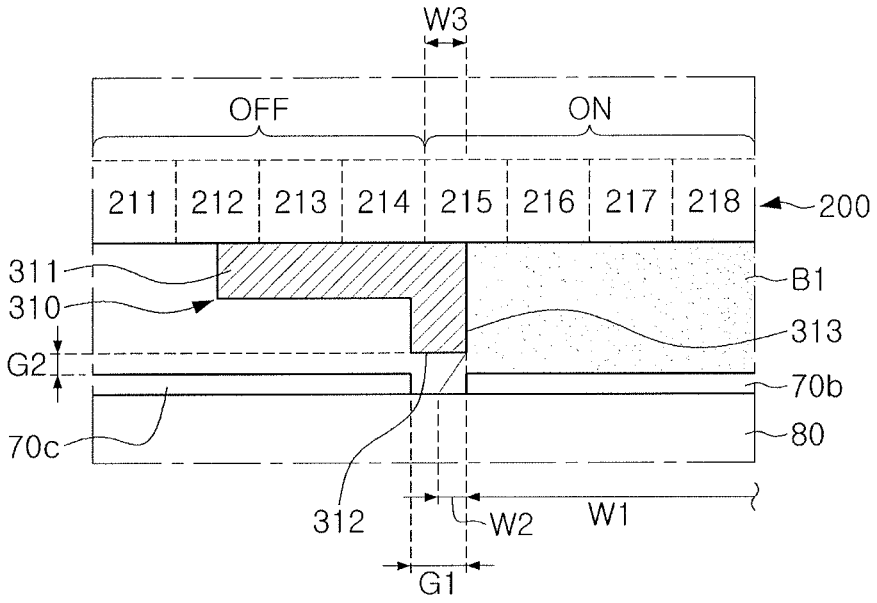
FIG. 5 illustrates an enlarged view of region A of FIG. 4.

With reference to FIGS. 4 and 5, as the shutter part 300 covers a portion of UV light irradiated by the plurality of UV LEDs 200, UV light having an area W1 sufficient to only cure a display cell to be cured and not to cure a display cell adjacent thereto may be provided. The shutter part 300 may include a first blocking portion 311 and a second blocking portion 312. The first blocking portion may be disposed in front of the plurality of UV LEDs 200, e.g., between the plurality of UV LEDs 200 and the stage 80, to block UV light from being incident outside irradiation region B1. The second blocking portion 312 protrudes from the first blocking portion 311 towards the stage 80 and further defines the irradiation region B1, e.g., a side surface of the second blocking portion 312 may be in contact with the irradiation region B1 such that the side surface is irradiated by light. The first blocking portion 311 may block ultraviolet light of a turned-on UV LED from being irradiated to an adjacent display cell 70*c*. The second blocking portion 312 may protrude from the first blocking portion 311 toward a front of the UV LED, e.g., in a direction in which the display cell is disposed, such that UV light of the irradiation region B1 may be prevented from being reflected or diffracted and from being irradiated toward an adjacent display cell 70*c*.

An interval G2 between the second blocking portion 312 and the display cell 70*b* to be irradiated may be sufficient to prevent UV light from being irradiated onto the adjacent display cell 70*c*, even when UV light reflected from a surface of the display cell 70*b* or diffracted on an end portion of the second blocking portion 312 is irradiated onto a region G1 between the display cell 70*c* and the display cell 70*b*. In an example embodiment, when the spaced region G1 is 5 mm to 10 mm, the interval G2 between the second blocking portion 312 and the display cell 70*b* may be 0.2 mm or less.

With reference to FIG. 5, among the plurality of UV LEDs 200 illustrated in FIG. 5, a UV LED 215 is turned on, but the area W1 of the display cell 70*b* to be irradiated by UV light is further reduced by a region of W3. Thus, if the area W1 of the irradiation region B1 is controlled with only an on/off operation of the UV LED, an error corresponding to the region W3+W2 may occur, to cause the irradiation of UV light to the adjacent display cell 70*c*. Thus, as the first shutter portion 310 according to an example embodiment may block a portion of UV light irradiated by the UV LED 215, UV light precisely corresponding to the area W1 of the display cell 70*b* to be cured may be provided, even when an area of irradiation light irradiated by the plurality of ultraviolet LEDs selectively turned on by the controller 40 is longer than the irradiation region B1.

Further, a reflective layer 313, to reflect irradiated UV light, may be on the side surface of the second blocking portion 312 in contact with the irradiation region B1.

Referring to FIG. 3, the driving unit 400 may include first and second driving portions 410 and 420, moving the first and second shutter portions 310 and 320 in the length (L1) direction of the housing 100, respectively. The driving unit 400 may be disposed on both sides of the housing 100. Operations of the driving unit 400 may be controlled by the controller 40. The driving unit 400 may be configured as a linear actuator, but is not limited thereto. For example, the driving may also be performed by a combined structure of a ball screw and a stepping motor.

The controller 40 may control the area W1 of the irradiation region of UV light irradiated to the display cell by selectively controlling on/off operations of the plurality of UV LEDs 200 and the driving unit 400. The controller 40 may include a central processing unit (CPU) configuring, e.g., a controller body, a read only memory (ROM) storing data required to perform processing executed by the CPU, a random access memory (RAM) including a memory region or the like to process various types of data by the CPU, and a data storage unit, e.g., a hard disk drive (HDD), a flash memory, or the like, storing data or a program to control respective parts by the CPU. In addition, the controller 40 may include an input device to allow data to be input to the controller 40 by a user.

For example, when a user inputs a size and disposition of a display cell via the input device, based on a predetermined program read by the data storage unit, the controller 40 may control the driving unit 400 to control a position of the shutter part 300, thereby precisely controlling the area W1 of the irradiation region B1 of UV light.

Subsequently, with reference to FIGS. 6 to 8, a modified example of the shutter part 300 of FIG. 3 will be described below. Configurations similar to those of the foregoing embodiment will be omitted, and mainly, a shutter part will be described below.

Figure 6:
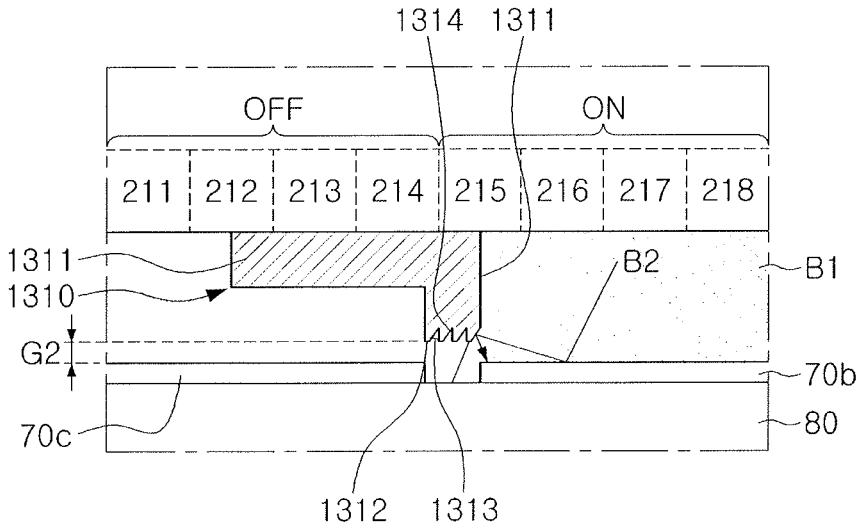
FIG. 6 illustrates a modified example of a shutter part of FIG. 5.

In the modified example of FIG. 6, a shutter part 1310 may be similar to that of the foregoing example embodiment, in that the shutter part includes a first blocking portion 1311 and a second blocking portion 1312, which correspond to the first blocking portion 311 and the second blocking portion 312, respectively, while also including a groove portion 1313 in a surface of the second blocking portion 1312, e.g., a bottom surface facing the stage 80. The groove portion 1313 may be provided with a sidewall inclined with respect to the irradiation region B1, e.g., away from the irradiation region. Thus, UV light B2 reflected from the irradiation region B1 may further be effectively blocked.

Figure 7:
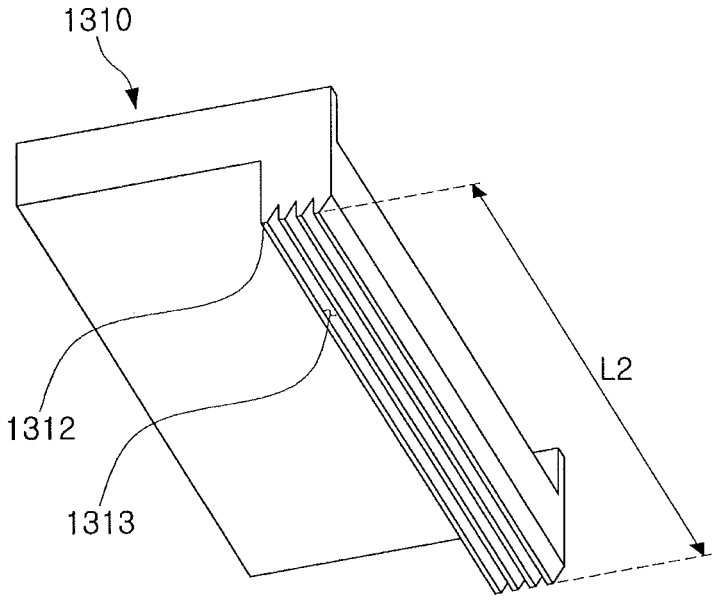
FIG. 7 illustrates a perspective view of the shutter part of FIG. 6.

As illustrated in FIG. 7, the groove portion 1313 may be provided as a plurality of groove portions formed in parallel in a width (L2) direction, e.g., orthogonal to the length (L1) direction of a housing. A width, height, and/or pitch of the groove portion 1313 may be variously modified.

Figure 8:
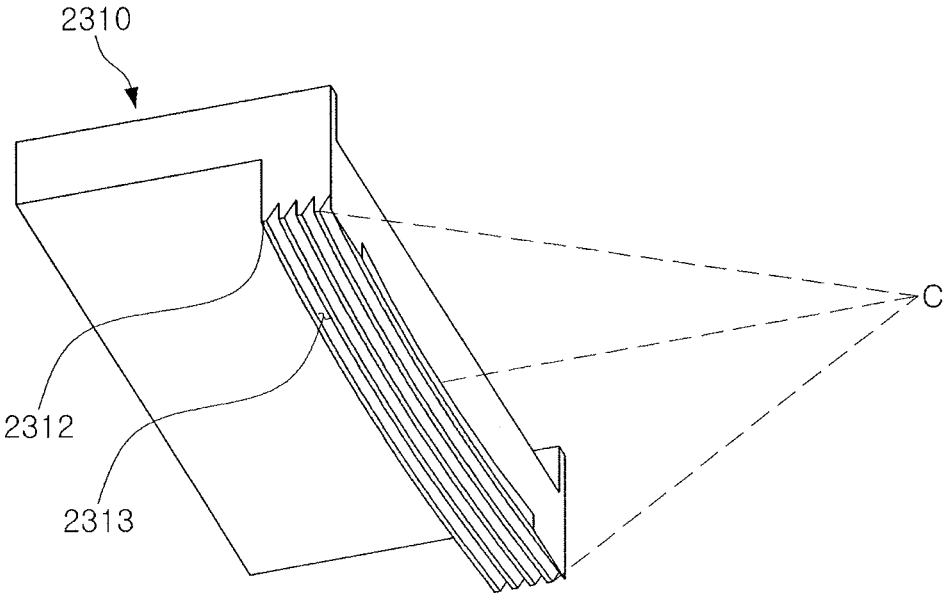
FIG. 8 illustrates a modified example of the shutter part of FIG. 7.

A shutter part 2310 of FIG. 8 is similar to the example embodiment of FIG. 7, in that a plurality of groove portions 2313 may be formed in parallel to each other in a width (L2) direction of the housing in a surface of a second blocking portion 2312. However, the plurality of groove portions 2313 have one arc shape centered on a virtual point C within an irradiation region. The groove portion 2313 having such a shape may have characteristics that UV light reflected by the groove portion 2313 is directed towards the virtual point C within the irradiation region. Thus, UV light may be further efficiently prevented from being irradiated onto an adjacent display cell.

As set forth above, an ultraviolet curing apparatus according to an example embodiment may precisely control an irradiation region of irradiated ultraviolet light. In particular, by including moveable shutter parts, in connection with selectively controlling the emission of individual ultraviolet light emitting diodes, an irradiation region may be precisely controlled.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An ultraviolet curing apparatus, comprising:

a housing;

a plurality of ultraviolet light emitting diodes (LEDs) arranged in a length direction of the housing; and at least one shutter part, movable in the length direction, coupled to the housing, the at least one shutter part to cover at least a portion of the plurality of ultraviolet LEDs to limit an irradiation region of ultraviolet light emitted by the plurality of ultraviolet LEDs, wherein the at least one shutter part includes:

a first blocking portion in front of the plurality of LEDs; and a second blocking portion protruding from the first blocking portion away from the plurality of ultraviolet LEDs and contacting the irradiation region, wherein the second blocking portion includes a groove portion having a linear shape in a front surface of the second blocking portion, in a width direction of the housing.

2. The ultraviolet curing apparatus as claimed as claim 1, wherein the groove portion includes a plurality of groove portions formed in parallel in the width direction.

3. The ultraviolet curing apparatus as claimed as claim 1, wherein the groove portion includes a side wall inclined with respect to the irradiation region.

4. The ultraviolet curing apparatus as claimed as claim 2, wherein the second blocking portion includes a plurality of groove portions having an arc shape centered on a virtual point in the irradiation region.

5. The ultraviolet curing apparatus as claimed as claim 1, wherein the housing includes a coupling groove portion formed in a side of the housing in the length direction, and the shutter part is movably coupled to the coupling groove portion.

6. The ultraviolet curing apparatus as claimed as claim 1, wherein:

the shutter part includes a first shutter portion and a second shutter portion, and the first shutter portion and the second shutter portion are spaced apart from each other to have the irradiation region interposed between the first and second shutter portions.

7. The ultraviolet curing apparatus as claimed as claim 6, wherein the first and second shutter portions are disposed symmetrically with respect to each other, with the irradiation region interposed between the first and second shutter portions.

8. The ultraviolet curing apparatus as claimed as claim 1, wherein the shutter part is further provided with a reflective layer on a side of the shutter part in contact with the irradiation region.

9. An ultraviolet curing apparatus, comprising:

a housing having a first surface in a length direction;

a plurality of ultraviolet LEDs on the first surface of the housing in the length direction;

a controller to selectively control an on/off operation of the plurality of ultraviolet LEDs to adjust an irradiation region of ultraviolet light emitted by the plurality of ultraviolet LEDs;

a driving unit controlled by the controller; and at least one shutter part to cover at least a portion of the first surface to provide a region in which ultraviolet light is blocked, at least one shutter part being movable in the length direction by the driving unit, wherein the at least one shutter part includes:

a first blocking portion in front of the plurality of LEDs; and a second blocking portion protruding from the first blocking portion away from the plurality of ultraviolet LEDs and contacting the irradiation region, wherein the second blocking portion includes a groove portion having a linear shape in a front surface of the second blocking portion, in a width direction of the housing.

10. The ultraviolet curing apparatus as claimed as claim 9, wherein the at least one shutter part is provided with a groove portion having a linear shape, formed in a front surface thereof, in a width direction of the housing.

11. The ultraviolet curing apparatus as claimed as claim 9, wherein:

the at least one shutter part includes a first shutter portion and a second shutter portion, and the first shutter portion and the second shutter portion are spaced apart from each other along the length direction with the irradiation region interposed between the first and second shutter portions.

12. The ultraviolet curing apparatus as claimed as claim 9, wherein:

the at least one shutter part includes a first shutter portion and a second shutter portion, and the driving unit includes a first driving portion and a second driving portion coupled to the first shutter portion and the second shutter portion, respectively.

13. The ultraviolet curing apparatus as claimed as claim 12, wherein:

the first and second shutter portions are spaced apart from each other with the irradiation region interposed between the first and second shutter portions, and an area of irradiation light irradiated by the plurality of ultraviolet LEDs selectively turned on by the controller is longer than the irradiation region.

14. The ultraviolet curing apparatus as claimed as claim 9, wherein the driving unit is a linear actuator.

15. An ultraviolet curing apparatus, comprising:

a linear housing positioned above a stage to support an imprint mold;

a plurality of ultraviolet LEDs arranged in the linear housing in a length direction of the housing, to irradiate ultraviolet light onto the stage;

at least one shutter part movably coupled to the linear housing in the length direction, to block a space between the plurality of ultraviolet LEDs and the stage, wherein the at least one shutter part includes:

a first blocking portion in front of the plurality of LEDs; and a second blocking portion protruding from the first blocking portion away from the plurality of ultraviolet LEDs and contacting the irradiation region, wherein the second blocking portion includes a groove portion having a linear shape in a front surface of the second blocking portion, in a width direction of the housing;

a driving unit on the linear housing to move the at least one shutter part in the length direction; and a controller to selectively control an on/off operation of the plurality of ultraviolet LEDs to adjust an irradiation region of ultraviolet light emitted by the plurality of ultraviolet LEDs and to control a region in which the at least one shutter part blocks the irradiation region by controlling the driving unit.

16. The ultraviolet curing apparatus as claimed as claim 15, wherein an area of the ultraviolet light irradiated by the plurality of ultraviolet LEDs selectively turned on by the controller is longer than an area of light irradiated on to the stage.

17. The ultraviolet curing apparatus as claimed as claim 16, wherein a length of the housing is greater than a length of the imprint mold in the length direction.

18. The ultraviolet curing apparatus as claimed as claim 15, wherein the linear housing moves above the stage while maintaining a predetermined gap therewith.

* * * * *